US009081325B2

(12) United States Patent
Onuki

(10) Patent No.: US 9,081,325 B2
(45) Date of Patent: Jul. 14, 2015

(54) IMAGE FORMING DEVICE, AND NON-TRANSITORY COMPUTER READABLE RECORDING MEDIUM

(71) Applicant: FUJI XEROX CO., LTD., Minato-ku, Tokyo (JP)

(72) Inventor: Tomio Onuki, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/271,894

(22) Filed: May 7, 2014

(65) Prior Publication Data

US 2015/0153679 A1 Jun. 4, 2015

(30) Foreign Application Priority Data

Nov. 29, 2013 (JP) ..... 2013-248418

(51) Int. Cl.
*G03G 15/00* (2006.01)
*G03G 15/08* (2006.01)

(52) U.S. Cl.
CPC ..... *G03G 15/0822* (2013.01); *G03G 15/0891* (2013.01); *G03G 15/0893* (2013.01); *G03G 15/5008* (2013.01); *G03G 2215/0819* (2013.01); *G03G 2215/0822* (2013.01); *G03G 2215/0838* (2013.01)

(58) Field of Classification Search
CPC ..... G03G 15/5008; G03G 15/0891; G03G 15/0893; G03G 2215/0819; G03G 2215/0822; G03G 2215/0838
USPC ..... 399/43
See application file for complete search history.

(56) References Cited

U.S. PATENT DOCUMENTS

| | | | | |
|---|---|---|---|---|
| 7,676,167 | B2 * | 3/2010 | Yoshioka et al. | 399/53 |
| 2004/0179865 | A1 | 9/2004 | Nishiyama | |
| 2007/0053703 | A1 * | 3/2007 | Hirayama | 399/27 |
| 2007/0154242 | A1 * | 7/2007 | Matsumoto et al. | 399/254 |
| 2007/0253720 | A1 * | 11/2007 | Kasai | 399/27 |
| 2011/0052233 | A1 * | 3/2011 | Sakamaki | 399/53 |
| 2011/0064435 | A1 * | 3/2011 | Takahashi et al. | 399/58 |
| 2014/0003827 | A1 * | 1/2014 | Arimura | 399/43 |

FOREIGN PATENT DOCUMENTS

| | | | |
|---|---|---|---|
| JP | 11-184225 | A | 7/1999 |
| JP | 2003-122098 | A | 4/2003 |
| JP | 2004-272017 | A | 9/2004 |
| JP | 2010243766 | A * | 10/2010 |

* cited by examiner

*Primary Examiner* — David Gray
*Assistant Examiner* — Tyler Hardman
(74) *Attorney, Agent, or Firm* — Sughrue Mion, PLLC

(57) ABSTRACT

Provided is an image forming device including an image holding member that is rotatable at a first speed and a second speed, a developing unit that includes a developing part that is rotatable at a third speed and a fourth speed, and a carrying part that is rotatable at a fifth speed and a sixth speed, and a control unit that executes a change of a high speed mode in which the image holding member is operated at the first speed, the developing part is operated at the third speed and the carrying part is operated at the fifth speed to perform development and a low speed mode in which the image holding member is operated at the second speed, the developing part is operated at the fourth speed and the carrying part is operated at the sixth speed to perform development.

17 Claims, 11 Drawing Sheets

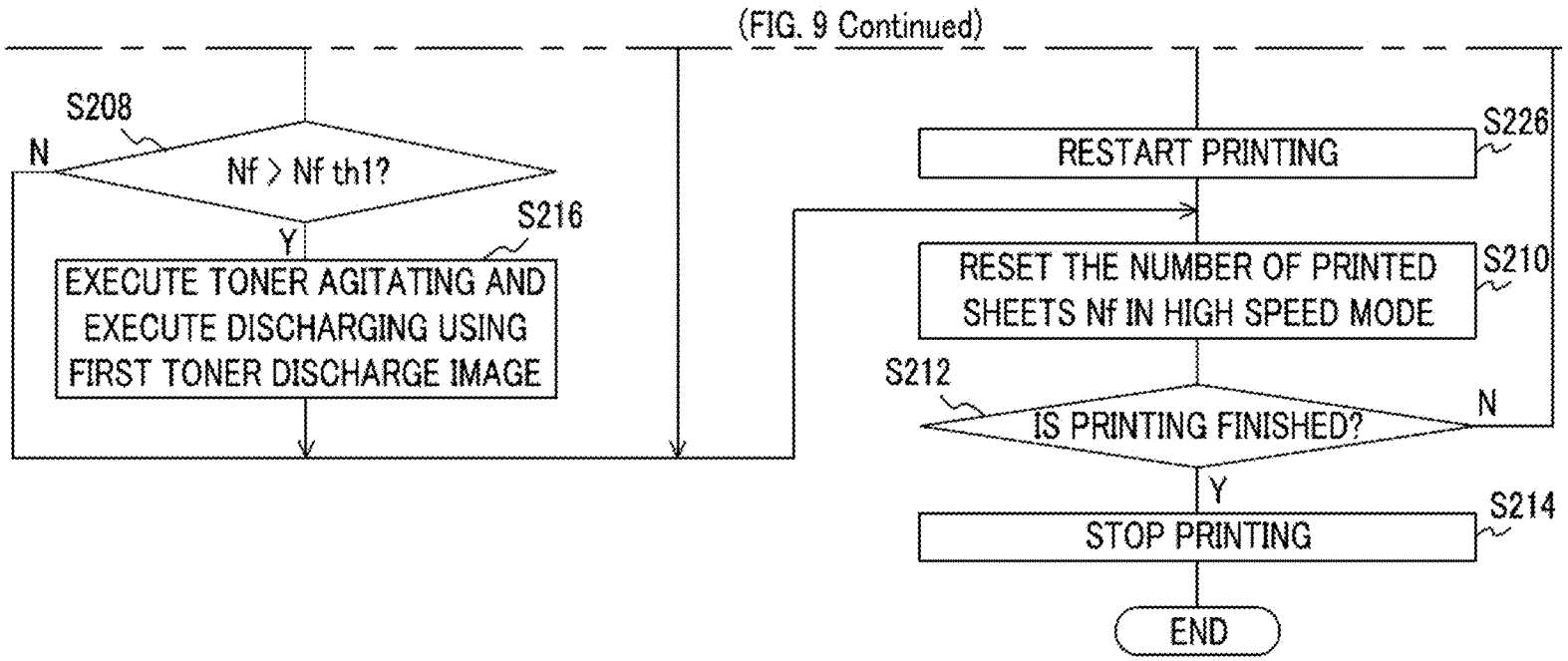
(FIG. 9 Continued)
S208
Nf > Nf th1?
N
Y
S216
EXECUTE TONER AGITATING AND EXECUTE DISCHARGING USING FIRST TONER DISCHARGE IMAGE
S226
RESTART PRINTING
S210
RESET THE NUMBER OF PRINTED SHEETS Nf IN HIGH SPEED MODE
S212
IS PRINTING FINISHED?
N
Y
S214
STOP PRINTING
END

IMAGE FORMING DEVICE, AND NON-TRANSITORY COMPUTER READABLE RECORDING MEDIUM

CROSS-REFERENCE TO RELATED APPLICATIONS

This application is based on and claims priority under 35 USC 119 from Japanese Patent Application No. 2013-248418 filed Nov. 29, 2013.

BACKGROUND

Technical Field

The present invention relates to an image forming device, and a non-transitory computer readable recording medium.

SUMMARY

According to an aspect of the invention, there is provided an image forming device including:

an image holding member that is rotatable at a first speed and a second speed slower than the first speed;

a developing unit that includes:

a developing part that is rotatable at a third speed and a fourth speed slower than the third speed and supplies a two-component developer including toner and carrier to the image holding member to develop a latent image formed on the image holding member with the toner; and a carrying part that is rotatable at a fifth speed and a sixth speed slower than the fifth speed and carries the two-component developer supplied to the developing part while agitating the two-component developer in an accommodating part; and a control unit that executes a change of a high speed mode in which the image holding member is operated at the first speed, the developing part is operated at the third speed and the carrying part is operated at the fifth speed to perform development and a low speed mode in which the image holding member is operated at the second speed, the developing part is operated at the fourth speed and the carrying part is operated at the sixth speed to perform development, the control unit performing a control so that when an amount corresponding to an amount of the toner supplied to the image holding member by the development in the high speed mode exceeds a threshold value, the carrying part rotates at a speed that is slower than the first speed while maintaining the image holding member at the first speed.

BRIEF DESCRIPTION OF THE DRAWINGS

Exemplary embodiments of the present invention will be described in detail based on the following figures, wherein.

DETAILED DESCRIPTION

First Exemplary Embodiment

An example of an image forming device and a developing unit according to an exemplary embodiment of the invention will be described with reference to FIGS. 1 to 4. In a front view of the image forming device, an arrow Y direction illustrated in each figure represents an up and down direction of the device, which is a vertical direction, and an arrow X direction represents a width direction of the device, which is a horizontal direction.

Overall Configuration

Figure 1:
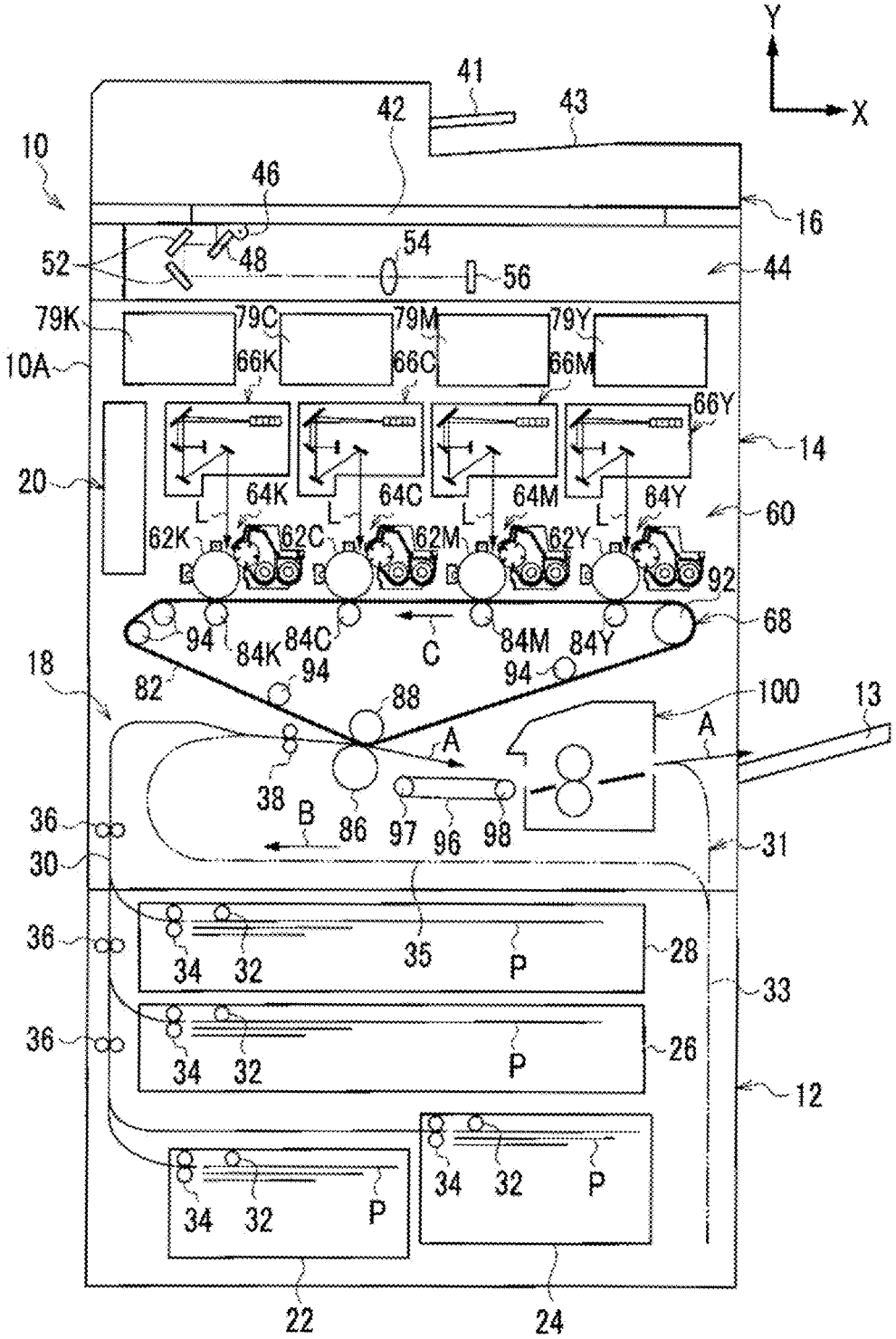
FIG. 1 is a schematic configuration diagram illustrating an image forming device according to an exemplary embodiment.

As illustrated in FIG. 1, an image forming device 10 includes a sheet accommodating section 12 in which a sheet member P that is an example of a recording medium is accommodated, a main operating section 14 that is provided above the sheet accommodating section 12 and performs image formation on the sheet member P supplied from the sheet accommodating section 12, an original document reading section 16 that is provided above the main operating section 14 and reads an original document (not illustrated), a transport section 18 that transports the sheet member P to the respective sections, and a main control section 20 that is provided in the main operating section 14 to control an operation of each section of the image forming device 10, from a lower side toward an upper side in the vertical direction. Further, the image forming device 10 includes a device main body 10A that is formed by plural frame members.

Sheet Accommodating Section

The sheet accommodating section 12 includes a first accommodating portion 22, a second accommodating portion 24, a third accommodating portion 26 and a fourth accommodating portion 28 that are capable of accommodating the sheet members P having different sizes. Each of the first accommodating portion 22, the second accommodating portion 24, the third accommodating portion 26 and the fourth accommodating portion 28 includes a feed roller 32 that feeds the accommodated sheet member P one by one, and transport rollers 34 that transport the fed sheet member P to a transport path 30 provided in the image forming device 10.

Transport Section

The transport section 18 includes plural transport rollers 36 that are disposed on a downstream side with reference to the transport roller 34 in a transport direction of the sheet member P on the transport path 30 and transport the sheet member P one by one. Further, positioning rollers 38 that perform positioning of image transfer by once stopping the sheet member P and feeding the sheet member P to a secondary image transfer position (to be described later) at a predetermined timing is disposed on a downstream side with reference to the transport rollers 36 in the transport direction of the sheet member P.

In the front view of the image forming device 10, an upstream part of the transport path 30 is linearly formed upward in the vertical direction from a left side in the figure of the sheet accommodating section 12 in the horizontal direction to a lower left part in the figure of the main operating section 14 in the horizontal direction. Further, a downstream part of the transport path 30 is extended from a lower left part in the figure of the main operating section 14 in the horizontal direction to a sheet discharge section 13 provided in a lower right part in the figure of the main operating section 14 in the horizontal direction.

Further, a both-side transport path 31 where the sheet member P is transported and reversed is connected to the transport path 30 in order to form an image on both sides of the sheet member P. The transport direction of the sheet member P when the both-side transport is not performed is indicated by an arrow A.

In the front view of the image forming device 10, the both-side transport path 31 includes a sheet-reversing portion 33 that is linearly provided in the vertical direction from the lower right part in the figure of the main operating section 14 in the horizontal direction to a right side in the figure of the sheet accommodating section 12 in the horizontal direction, and a transport portion 35 that transports the sheet member P to a left side in the figure (indicated by an arrow B) in the horizontal direction when a trailing edge of the sheet member P transported to the sheet-reversing portion 33 enters. Further, a downstream end part of the transport portion 35 is connected to an upstream side from the positioning rollers 38 of the transport path 30 by a guide member (not illustrated). In FIG. 1, a switching member that performs switching of the transport path 30 and the both-side transport path 31 and a switching member that performs switching of the sheet-reversing portion 33 and the transport portion 35 are not illustrated.

Original Document Reading Section

The original document reading section 16 includes a platen 41 on which plural original documents (not illustrated) may be placed, a platen glass 42 on which one original document is placed, an original document reading unit 44 that reads the original document placed on the platen glass 42, and an original document discharge portion 43 through which the read original document is discharged.

The original document reading unit 44 includes a light irradiation portion 46 that irradiates the original document placed on the platen glass 42 with light, one full rate mirror 48 and two half rate mirrors 52 that reflect the light that is irradiated by the light irradiation portion 46 and is reflected from the original document to be turned in a direction parallel to the platen glass 42, a focusing lens 54 onto which the reflected light that is turned by the full rate mirror 48 and the half rate mirrors 52 is incident, and a photoelectric conversion element 56 that converts the reflected light image-formed by the focusing lens 54 into an electric signal.

The electric signal converted by the photoelectric conversion element 56 is image-processed by an image processing unit (not illustrated) and is used for image formation. Further, the full rate mirror 48 moves at a full rate along the platen glass 42, and the half rate mirrors 52 move at a half rate along the platen glass 42.

Main Operating Section

The main operating section 14 includes an image forming portion 60 that forms a toner image on the sheet member P, and a fixing unit 100 that fixes the toner image formed on the sheet member P by the image forming portion 60 to the sheet member P by heat and pressure.

Image Forming Portion

The image forming portion 60 includes image forming units 64K, 64C, 64M and 64Y that include image holding members 62K, 62C, 62M and 62Y corresponding to respective toner of yellow (Y), magenta (M), cyan (C) and black (K); exposure units 66K, 66C, 66M and 66Y that emit light beams L toward outer circumferential surfaces of the image holding members 62K, 62C, 62M and 62Y for exposure; and a transfer unit 68 that transfers the toner images formed by the image forming units 64K, 64C, 64M and 64Y onto the sheet member P.

Hereinbelow, in a case where it is necessary to distinguish Y, M, C and K, description will be made by adding any alphabetic character of Y, M, C and K to a numeral. Similarly, in a case where it is not necessary to distinguish Y, M, C and K, the alphabetic characters of Y, M, C and K will not be added.

Exposure Unit (Image Forming Portion)

The exposure unit 66 has a configuration in which a light beam emitted from a light source (not illustrated) is scanned by a rotating polygon mirror (with no reference numeral) and is reflected by plural optical components including a reflecting mirror so that the light beam L corresponding to the toner of each color is output toward an image holding member 62 placed on a lower side.

Image Forming Unit (Image Forming Portion)

Figure 2:
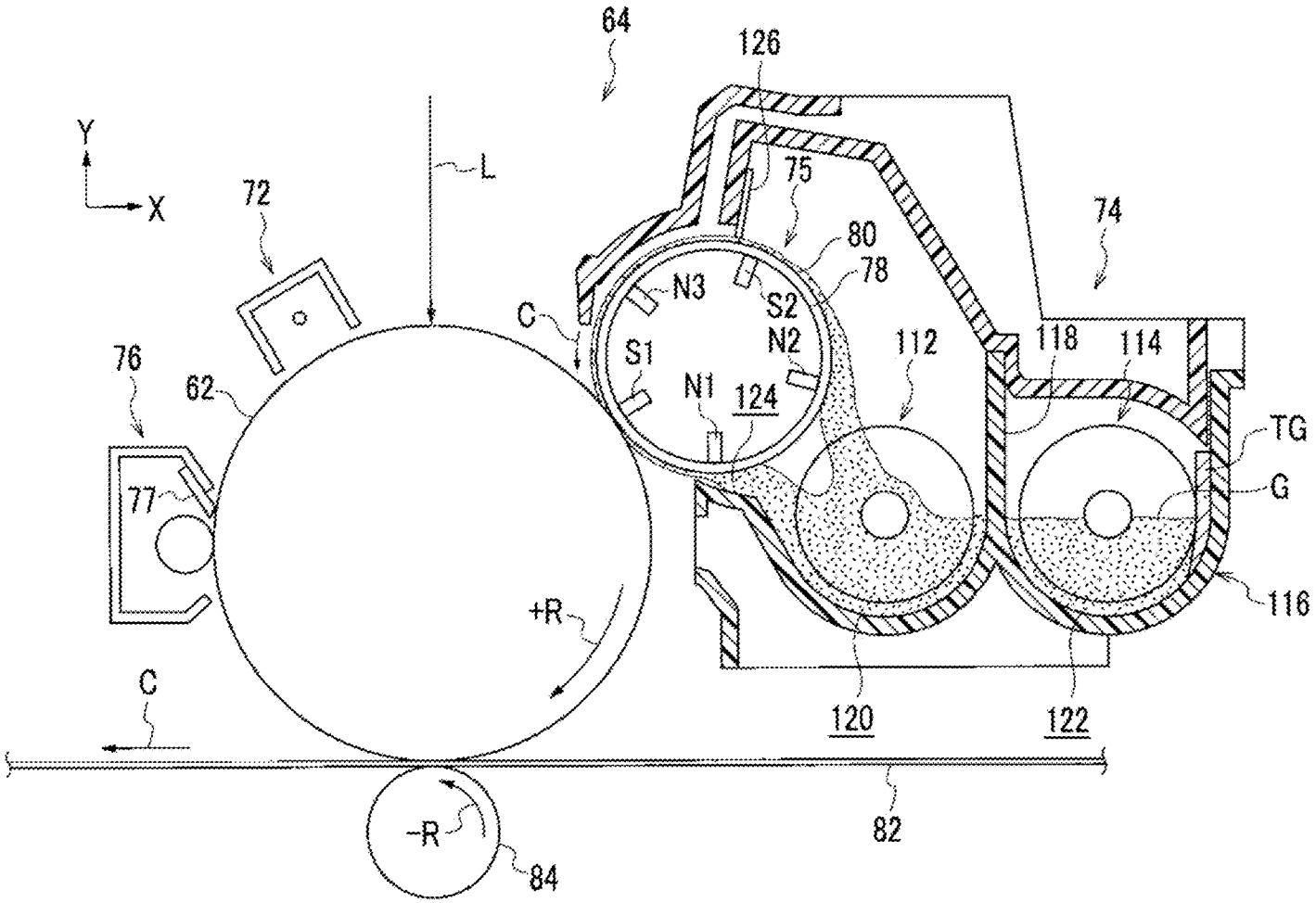
FIG. 2 is a side view illustrating a developing unit, an image holding member and the like used in an image forming device according to an exemplary embodiment.

As illustrated in FIG. 2, an image forming unit 64 includes the image holding member 62 of a columnar shape that is rotatable in an arrow +R direction (a clockwise direction in the figure), and a charging unit 72, a developing unit 74 and a cleaning member 76 that are sequentially arranged from an upstream side to a downstream side in the rotation direction to face the outer circumferential surface of the image holding member 62.

Further, the charging unit 72 and the developing unit 74 are disposed so that a position between the charging unit 72 and the developing unit 74 on the outer circumferential surface of the image holding member 62 is irradiated with the light beam L. Further, an intermediate image transfer belt 82 (to be described later) contacts with a position between the developing unit 74 and the cleaning member 76 on the outer circumferential surface of the image holding member 62.

Further, as an example, the charging unit 72 is configured by a corotron-type charging unit in which a voltage is applied to a wire to charge the outer circumferential surface of the image holding member 62 with the same polarity as in the toner by corona discharge. Here, by irradiating the outer circumferential surface of the charged image holding member 62 with the light beam L based on image data, a latent image (electrostatic latent image) is formed.

One developing unit 74 is provided for one image holding member 62. The developing unit 74 accommodates a two-component developer G (hereinafter, simply referred to as a "developer G") in which magnetic carrier particles and negatively charged toner are mixed, for example, and includes a developing roller 75 that faces the image holding member 62. The latent image formed on the image holding member 62 by the toner carried by the developing roller 75 is visualized as a toner image (a developer image).

The toner is supplied from each toner cartridge 79 (see FIG. 1) provided above the image forming portion 60 to each developing unit 74. Further, the developing unit 74 will be described later in detail.

The cleaning member 76 includes a cleaning blade 77 that contacts with the outer circumferential surface of the image holding member 62, and collects by scraping the toner that remains on the outer circumferential surface of the image holding member 62 by the cleaning blade 77. Further, on the downstream side with reference to the developing unit 74 in the rotation direction of the image holding member 62, the intermediate image transfer belt 82 through which the toner image developed by the developing unit 74 is primarily transferred is provided.

Transfer Unit (Image Forming Portion)

As illustrated in FIG. 1, the transfer unit 68 includes the endless-type intermediate image transfer belt 82, a primary image transfer roller 84 that primarily transfers the toner image onto the intermediate image transfer belt 82 from the image holding member 62, and a secondary image transfer roller 86 and an auxiliary roller 88 that secondarily transfer the toner images that are sequentially overlapped on the intermediate image transfer belt 82 onto the sheet member P.

Further, inside the intermediate image transfer belt 82, a drive roller 92 that is rotatably driven and plural transport rollers 94 that are rotatably supported are disposed. Further, the intermediate image transfer belt 82 is wound on primary image transfer rollers 84K, 84C, 84M and 84Y, the drive roller 92, the transport rollers 94 and the auxiliary roller 88. Thus, if the drive roller 92 is rotated in a counterclockwise direction as illustrated, the intermediate image transfer belt is moved while being turned in an arrow C direction (counterclockwise direction in the figure).

The primary image transfer roller 84 is disposed on a side opposite to the image holding member 62 with the intermediate image transfer belt 82 being interposed therebetween, and has a configuration in which an elastic layer (not illustrated) is formed around a columnar shaft formed of a metal such as stainless steel, for example. Further, opposite end portions of the shaft are supported by bearings to be rotatable. Further, the primary image transfer roller 84 is configured so that a voltage (positive voltage) having a polarity opposite to the polarity of the toner is applied to the shaft from a power source (not illustrated).

The secondary image transfer roller 86 has the same configuration as that of the primary image transfer roller 84, for example, and is disposed on the downstream side of the positioning rollers 38 on the transport path 30 to be rotatable. Further, the secondary image transfer roller 86 contacts with the outer circumferential surface of the intermediate image transfer belt 82 at the secondary image transfer position with the intermediate image transfer belt 82 being interposed between the secondary image transfer roller 86 and the auxiliary roller 88.

Further, the secondary image transfer roller 86 is grounded. Further, the auxiliary roller 88 forms a counter electrode of the secondary image transfer roller 86, and is configured so that a secondary image transfer voltage is applied thereto through a power supply roller (not illustrated) made of a metal that contacts with an outer circumferential surface of the auxiliary roller 88. Here, the secondary image transfer voltage (negative voltage) is applied to the auxiliary roller 88 so that an electric potential difference is generated between the auxiliary roller 88 and the secondary image transfer roller 86, and thus, the toner image on the intermediate image transfer belt 82 is secondarily transferred onto the sheet member P transported to a contact portion between the secondary image transfer roller 86 and the intermediate image transfer belt 82.

Others (Image Forming Portion)

On the downstream side from the secondary image transfer roller 86 in the movement direction of the sheet member P, a transport belt 96 that transports the sheet member P on which the secondary transfer of the toner image is completed to the fixing unit 100 is provided. The transport belt 96 is wound on a support roller 97 and a drive roller 98, and is moved while being turned to transport the sheet member P to the fixing unit 100.

Operation of Overall Configuration

Next, an operation of the image forming apparatus 10 according to the exemplary embodiment will be described.

When an image is formed on the sheet member P, as illustrated in FIG. 2, each image holding member 62 is charged by the charging unit 72, and is exposed by the light beam L emitted from each exposure unit 66 (see FIG. 1) according to image data, so that an electrostatic latent image is formed on the image holding members 62.

Subsequently, the electrostatic latent image formed on the outer circumferential surface of each image holding member 62 is developed as a toner image of each color of yellow (Y), magenta (M), cyan (C) and black (K) by the developing unit 74.

Then, the respective toner images formed on the surfaces of the respective image holing members 62 are sequentially multiply transferred onto the intermediate image transfer belt 82 by the respective primary image transfer rollers 84, at the primary image transfer position. Further, as illustrated in FIG. 1, the toner images multiply transferred to the intermediate image transfer belt 82 are secondarily transferred onto the sheet member P that is transported on the transport path 30 by the secondary image transfer roller 86 and the auxiliary roller 88, at the secondary image transfer position.

Then, the sheet member P with the toner image transferred thereto is transported toward the fixing unit 100 by the transport belt 96. Further, in the fixing unit 100, the toner image on the sheet member P is heated and pressurized to be fixed. As an example, the sheet member P with the toner image fixed thereto is discharged to the sheet discharge section 13. In this way, the series of image forming processes is performed.

When the toner image is formed on a non-image surface (rear surface) on which an image is not formed (in both-side image formation), the fixing unit 100 fixes the image on the front surface, and then, the sheet member P is fed to the both-side transport path 31 to perform the image formation and fixation on the rear surface.

Configuration of Main Part

Next, the developing unit 74 will be described.

As illustrated in FIG. 2, the developing unit 74 includes the developing roller 75 disposed to face the image holding member 62, a first agitating carriage auger 112 that is an example of a agitating carriage unit that is disposed below the developing roller 75 and agitates and carries the developer G supplied (pumped up) to the developing roller 75, a second agitating carriage auger 114 that is disposed adjacent to the first agitating carriage auger 112 (on the right side in the figure), and a housing 116 that accommodates the developing roller 75, the first agitating carriage auger 112 and the second agitating carriage auger 114.

Agitating Carriage Augers

Figure 3:
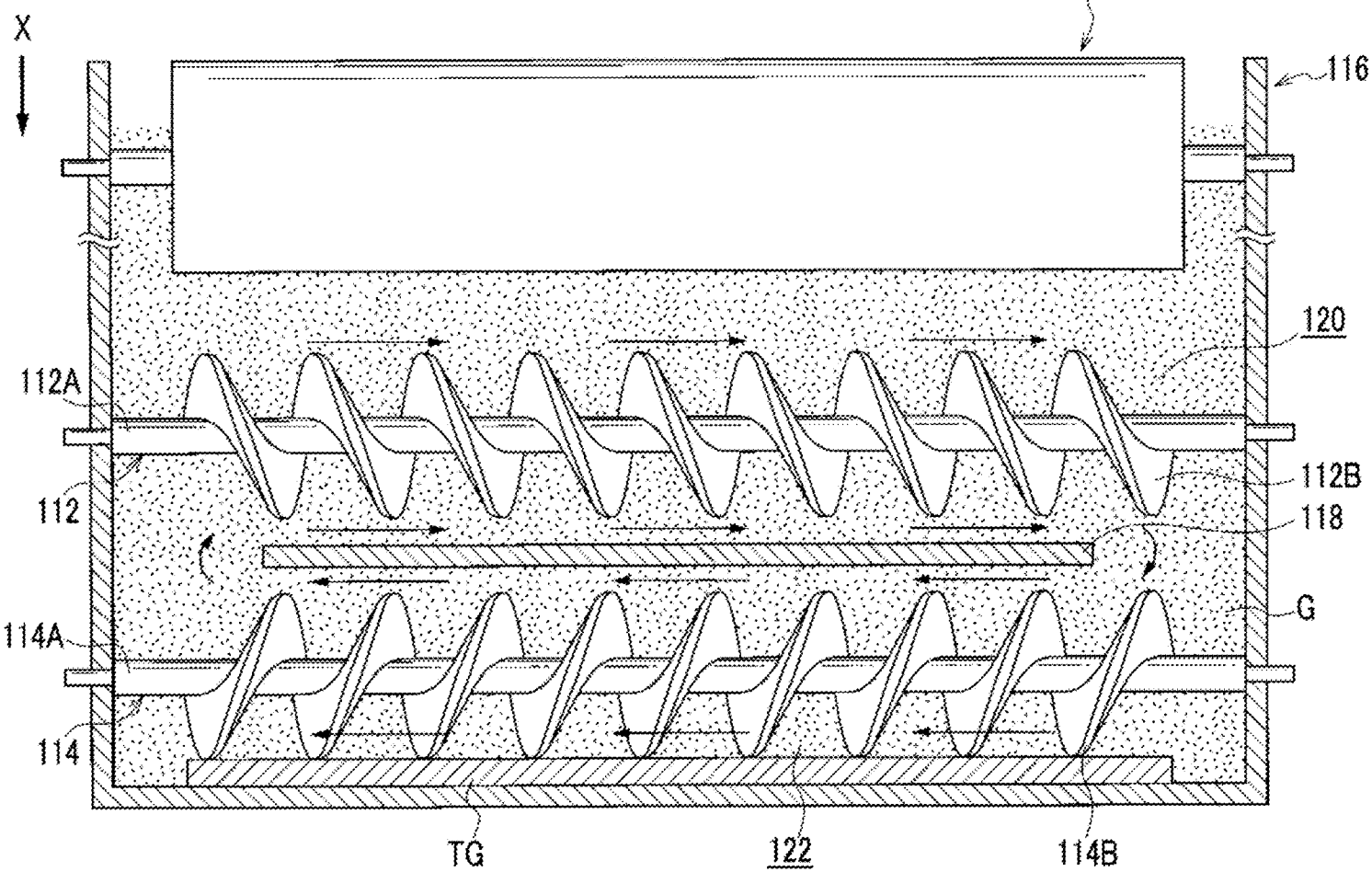
FIG. 3 is a plan view illustrating the inside of a developing unit according to an exemplary embodiment.

As illustrated in FIG. 3, the first agitating carriage auger 112 and the second agitating carriage auger 114 include a rotating shaft 112A and a rotating shaft 114A, respectively, and are rotatably supported on peripheral walls of the housing 116, respectively. Further, on the rotating shaft 112A and the rotating shaft 114A of the first agitating carriage auger 112 and the second agitating carriage auger 114, a spiral blade 112B and a spiral blade 114B are respectively provided.

Further, on the rotating shaft 112A and the rotating shaft 114A, gears (not illustrated) are fixed to end portions thereof that protrude outside the housing 116, respectively. Further, a rotational force is transmitted to the gears from a motor (not illustrated), and thus, the first agitating carriage auger 112 and the second agitating carriage auger 114 are rotated through the gears, respectively.

Further, as illustrated in FIG. 2, a partition wall 118 that rises upward from a bottom part of the housing 116 is formed between the first agitating carriage auger 112 and the second agitating carriage auger 114, and a first agitating path 120 where the first agitating carriage auger 112 is disposed and a second agitating path 122 where the second agitating carriage auger 114 is disposed are formed by the partition wall 118. Further, as illustrated in FIG. 3, opposite end portions of the partition wall 118 in a longitudinal direction are opened, and thus, the first agitating path 120 and the second agitating path 122 are connected to each other.

In this configuration, the developer G is carried in an arrow direction in the figure while being agitated inside the first agitating path 120 and the second agitating path 122 by the rotation of the first agitating carriage auger 112 and the second agitating carriage auger 114, and is circulated between the first agitating path 120 and the second agitating path 122.

Developing Roller and Layer Thickness Regulating Member

As illustrated in FIG. 2, the developing roller 75 is disposed to face the image holing member 62, and is applied with a negative developing bias voltage from a power source section (not illustrated). The developing roller 75 includes a cylindrical sleeve 80 that is rotated in a circumferential direction, and a columnar magnet roller 78 inserted inside the cylindrical sleeve 80.

Further, the cylindrical sleeve 80 receives a rotational force from a driving source (not illustrated) to rotate around the magnet roller 78 in an arrow C direction illustrated in FIG. 2.

Further, inside the magnet roller 78, five permanent magnets in which an S pole or an N pole is formed on a front surface side thereof are arranged at intervals along the circumferential direction of the cylindrical sleeve 80. Further, a developing pole S1 for moving the developer G to the image holding member 62 is disposed at a position that faces the image holding member 62. Further, a separation pole N1 that separates the developer G from the cylindrical sleeve 80 is disposed adjacent to the developing pole S1 along the rotational direction of the cylindrical sleeve 80. Further, as magnetic poles, a drawing pole N2 that draws the developer G onto the cylindrical sleeve 80, a developer regulating pole S2 and a carrying pole N3 are arranged in the order from the vicinity of the separation pole N1.

The developing pole S1 and the developer regulating pole S2 are S poles, and the separation pole N1, the drawing pole N2 and the carrying pole N3 are N poles.

Further, a plate-shaped layer thickness regulating member 126 that contacts with the developer G supplied (drawn) onto the cylindrical sleeve 80 to regulate the layer thickness of the developer G is disposed on a side opposite to the developer regulating pole S2 with the cylindrical sleeve 80 being interposed therebetween.

In this configuration, the developing pole S1 generates magnetic force lines necessary for moving the developer G on the cylindrical sleeve 80 to the image holding member 62. Further, as the separation pole N1 and the drawing pole N2 are adjacent to each other, the separation pole N1 generates magnetic force lines in a direction where the developer G on the cylindrical sleeve 80 is separated from the cylindrical sleeve 80. Further, the drawing pole N2 generates magnetic force lines in a direction where the developer G accommodated in the first agitating path 120 is drawn (absorbed) onto the cylindrical sleeve 80. Further, the developer regulating pole S2 generates magnetic force lines in a direction where the developer G is forced to face the layer thickness regulating member 126.

Next, an operation of the developing unit 74 will be described.

As illustrated in FIG. 3, the developer G is carried while being agitated inside the first agitating path 120 and the second agitating path 122 by the rotation of the first agitating carriage auger 112 and the second agitating carriage auger 114, and is circulated between the first agitating path 120 and the second agitating path 122.

Further, as illustrated in FIG. 2, if the cylindrical sleeve 80 rotates along the arrow C direction, the developer G carried while being agitated inside the first carriage path 120 is drawn onto the cylindrical sleeve 80 by the drawing pole N2.

Figure 4:
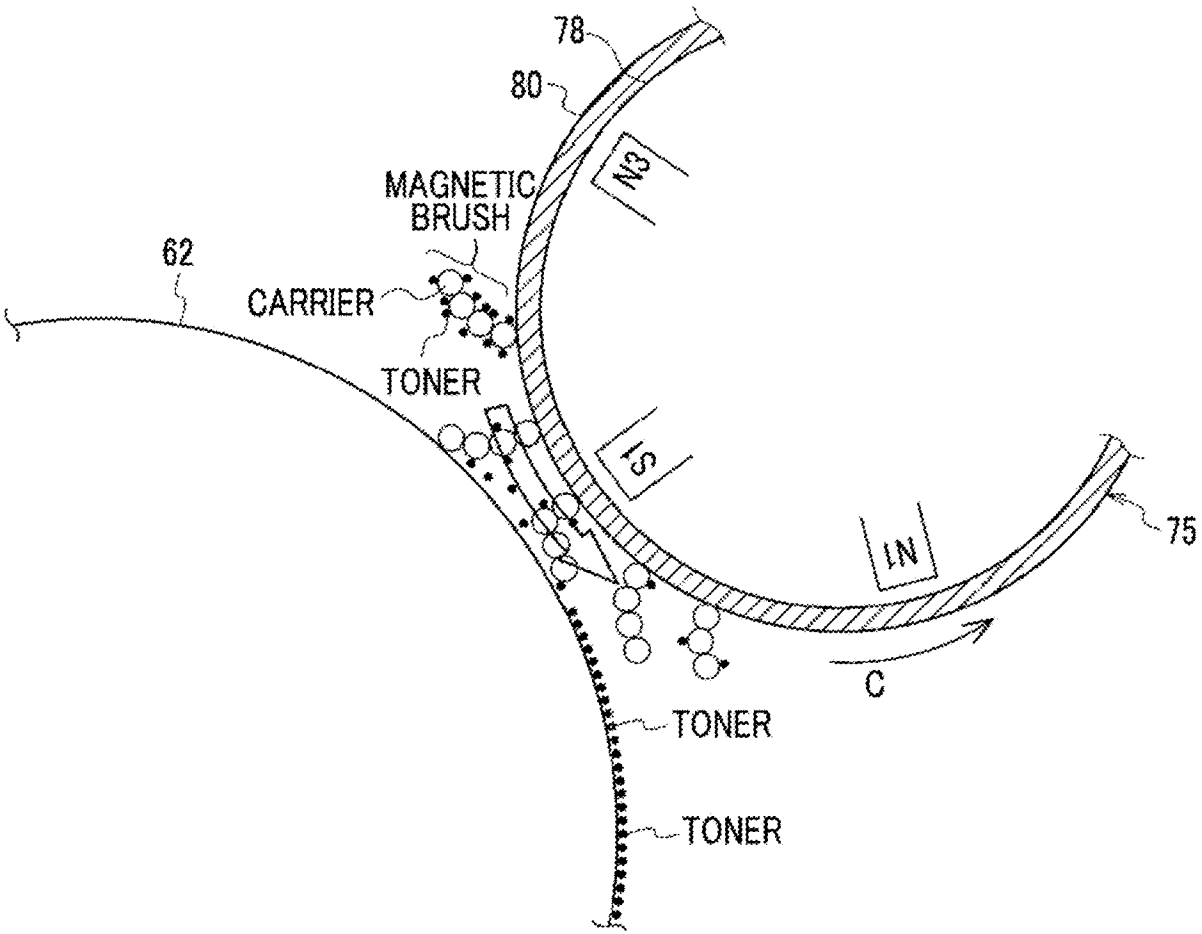
FIG. 4 is a diagram illustrating a magnetic brush attached to a developing roller used in a developing unit according to an exemplary embodiment.

Further, the developer G drawn onto the cylindrical sleeve 80 is arranged in the direction of the magnetic force lines on the surface of the cylindrical sleeve 80, and carrier that retains the toner extends along the magnetic force lines to form a magnetic brush (see FIG. 4).

The magnetic brush that is formed by being drawn onto the cylindrical sleeve 80 by the drawing pole N2 is transported in the order of the developer regulating pole S2, the carrying pole N3, the developing pole S1 and the separation pole N1 as the cylindrical sleeve 80 rotates along the arrow C direction.

Further, when the developer G passes through the developer regulating pole S2, the developer G contacted with the layer thickness regulating member 126 to regulate the layer thickness, so that the height of the magnetic brush is adjusted.

Further, due to an electric potential difference between the developing roller 75 and the image holding member 62, generated by the developing bias voltage applied to the developing roller 75, as illustrated in FIG. 4, in the developing pole S1, the toner on the magnetic brush moves to the image holding member 62, and the magnetic brush including the toner that does not move to the image holding member 62 remains on the surface of the cylindrical sleeve 80. As illustrated in FIG. 2, this magnetic brush is separated from the cylindrical sleeve 80 in the separation pole N1 according to the rotation of the cylindrical sleeve 80 to be returned to the inside of the housing 116. In FIG. 4, the carrier and the toner that form the developer G is exaggeratedly illustrated so that the magnetic brush may be easily understood.

Figure 5:
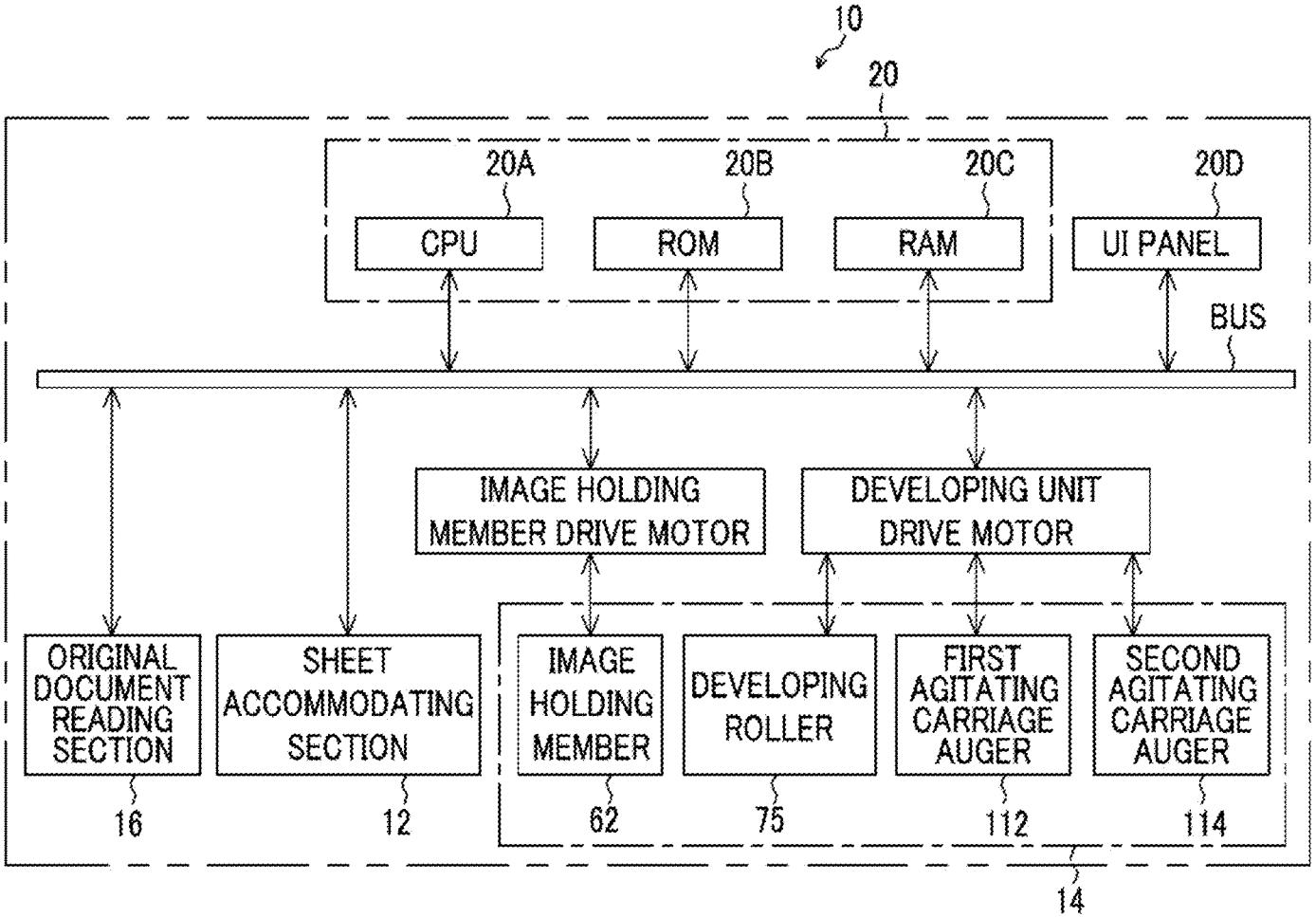
FIG. 5 is a block diagram illustrating a configuration of a main part of an electric system of an image forming device according to an exemplary embodiment.

Next, a configuration of an electric system of the image forming device 10 according to the exemplary embodiment will be described with reference to FIG. 5. As described above, the main control section 20 illustrated in FIG. 5 is a section that controls the operations of the respective sections of the image forming device 10, and includes a CPU 20A, a ROM 20B and a RAM 20C. The CPU 20A, the ROM 20B and the RAM 20C are respectively connected to a BUS, and may perform transmission and reception of control commands, data or the like therebetween.

The CPU 20A causes a program stored in the ROM 20B to be read into the RAM 20C, for example, and executes the read program to control the entire operation of the image forming device 10. In the ROM 20B, various programs such as a toner agitating process program (to be described later), information about various parameters or various tables, and the like are stored in advance. The RAM 20C is a memory used as a work area when the various programs are executed, or the like.

Further, a UI panel 20D (not illustrated in FIG. 1) is connected to the BUS. The UI panel 20D includes display buttons that realize reception of an operation instruction based on various programs, a display (not illustrated) of a touch panel type on which various information is displayed, hardware keys (not illustrated) such as ten keys and a start button, and the like.

As illustrated in FIG. 5, the original document reading section 16, the sheet accommodating section 12 and the main operating section 14 that form the image forming device 10 are also connected to the BUS, and the CPU 20A controls the original document reading section 16, the sheet accommodating section 12 and the main operating section 14 through the BUS.

In FIG. 5, among the components included in the main operating section 14, the image holding member 62, the developing roller 75, the first agitating carriage auger 112 and the second agitating carriage auger 114 in the image forming portion 60 that is a characteristic component relating to the exemplary embodiment are extractively illustrated. The image holding member 62 is connected to the BUS through a motor (hereinafter, referred to as an "image holding member drive motor") controlled by the CPU 20A. Further, the developing roller 75, the first agitating carriage auger 112 and the second agitating carriage auger 114 are also connected to the BUS through a motor (hereinafter, referred to as a "developing unit drive motor") controlled by the CPU 20A. In the image forming device 10 according to the exemplary embodiment, the developing roller 75, the first agitating carriage auger 112 and the second agitating carriage auger 114 are configured to be interlocked by one developing unit drive motor.

Figure 6:
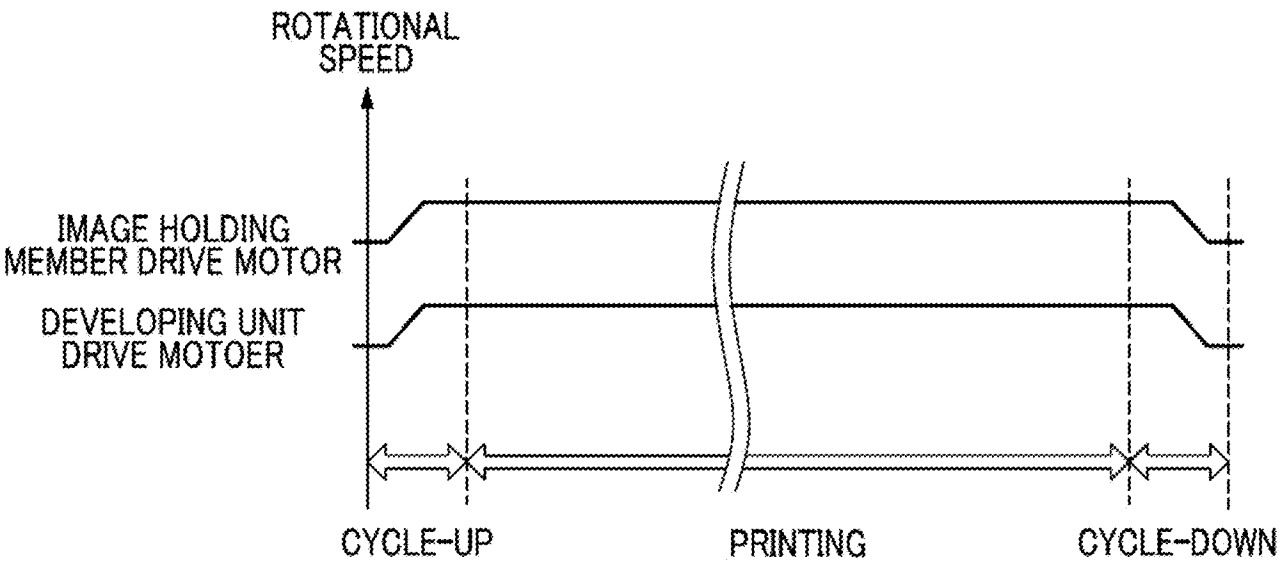
FIG. 6 is a conceptual diagram illustrating an operation of each motor in a period of time from a cycle-up period to a cycle-down period in an image forming device according to an exemplary embodiment.

FIG. 6 illustrates an example of an operation state in image formation (the "image formation" is indicated as "printing" in FIG. 6, and the "image formation" to the sheet member P may be hereinafter referred to as the "printing") of the image holding member drive motor and the developing unit drive motor, which illustrates states of rotational speeds at a timing of the image formation and timings before and after the image formation.

As illustrated in FIG. 6, if the printing is started at a predetermined process speed, the image holding member drive motor and the developing unit drive motor are synchronized to start their rotations, and the rotational speeds increase up to rotational speeds regulated at the process speed. Further, if the printing is finished, the rotational speeds of image holding member drive motor and the developing unit drive motor decrease down to predetermined rotational speeds or are stopped. Here, the process speed is expressed as a circumferential speed of the image holding member 62, which means an index of a processing speed of the entire image forming process.

In the states of the rotational speeds of the image holding member drive motor and the developing unit drive motor illustrated in FIG. 6, a certain period of time before the printing is started is referred to as a cycle-up period, and a certain period of time after the printing is finished is referred to as a cycle-down period. Here, the cycle-up period represent an operation of gradually increasing the electric potential of the image holding member 62 or the bias voltage of each section from a standby state before the printing is started, increasing the rotational speeds of the image holding member drive motor and the developing unit drive motor up to the predetermined rotational speeds and performing a preparation for image formation. Further, the cycle-down period represents a reverse operation of the operation in the cycle-up period, which is an operation of gradually decreasing the electric potential of the image holding member 62 or the bias voltage of each section, and then, sequentially stopping the image holding member drive motor and the developing unit drive motor.

However, in the developing unit 74 of the image forming device 10 according to the exemplary embodiment, as illustrated in FIGS. 2 and 3, in gaps between rotational circumferential raceway surfaces of the spiral blade 112B and the spiral blade 114B (hereinafter, the spiral blade 112B and the spiral blade 114B may be collectively referred to as "spiral blades") of the augers and the inner wall of the housing 116 of the developing unit 74, the developer G that is insufficiently agitated may remain as a remaining developer TG. If the remaining developer TG collapses at a certain timing, the remaining developer TG may be carried to the developing roller 75 in the state of insufficiently agitated, and an image may be formed on the sheet member P by the toner included in the remaining developer TG.

On the other hand, the image forming device may have plural process speeds in accordance with respective characteristics of the sheet member P so that the printing is properly performed according to different characteristics such as thickness or material of the sheet member P that is an object of the printing. The image forming device 10 according to the exemplary embodiment also has two process speed modes of a high speed mode where the image formation is performed at a relatively high process speed and a low speed mode where the image formation is performed at a relatively low process speed, for example.

Particularly, in an image forming device having the plural process speeds as in the image forming device 10 according to the exemplary embodiment, a carriage capacity of the developer G varies according to the rotational speeds of the augers, and thus, a phenomenon also occurs that a difference is generated in the degree of occurrence of the remaining developer TG. That is, when the rotational speeds of the augers are relatively low, the carriage capacity of the developer G in the vicinity of the circumferences of the augers increases, and thus, the generation amount of the remaining developer G decreases. On the other hand, when the rotational speeds of the augers are relatively high, the carriage capacity of the developer G in the vicinity of the circumferences of the augers decreases, and thus, the generation amount of the remaining developer TG increases.

When the process speed is changed from the high speed mode to the low speed mode, the circumferential speed of the developing roller 75 is also changed to the low speed in association with the reduction of the circumferential speed of the image holing member 62. In the exemplary embodiment, since the developing roller 75 and the augers are driven together by the developing unit drive motor, the rotational speeds of the augers are also changed to the low speed. In this case, the remaining developer TG that remains in the high speed mode may collapse according to the change to the low speed mode, and the developer G that is insufficiently agitated may be easily supplied to the developing roller 75. Thus, the above-mentioned problem such as fog or dirty toner may easily occur. Further, as a speed difference between the high speed mode and low speed mode is large, the amount of the remaining developer TG that collapses when the mode is changed from the high speed mode to the low speed mode increases, and thus, such a problem becomes noticeable.

Thus, the image forming device 10 according to the exemplary embodiment executes, when the image is formed in the high speed mode, an operation of lowering only the drive speed (rotational speeds of the augers) of the developing unit 74 to the low speed without changing the process speed to agitate the developer G, and discharging the remaining developer TG from the developing unit 75 as a toner image to the image holding member 62 (hereinafter, the operation is referred to as a "agitating and discharging operation").

Figure 7:
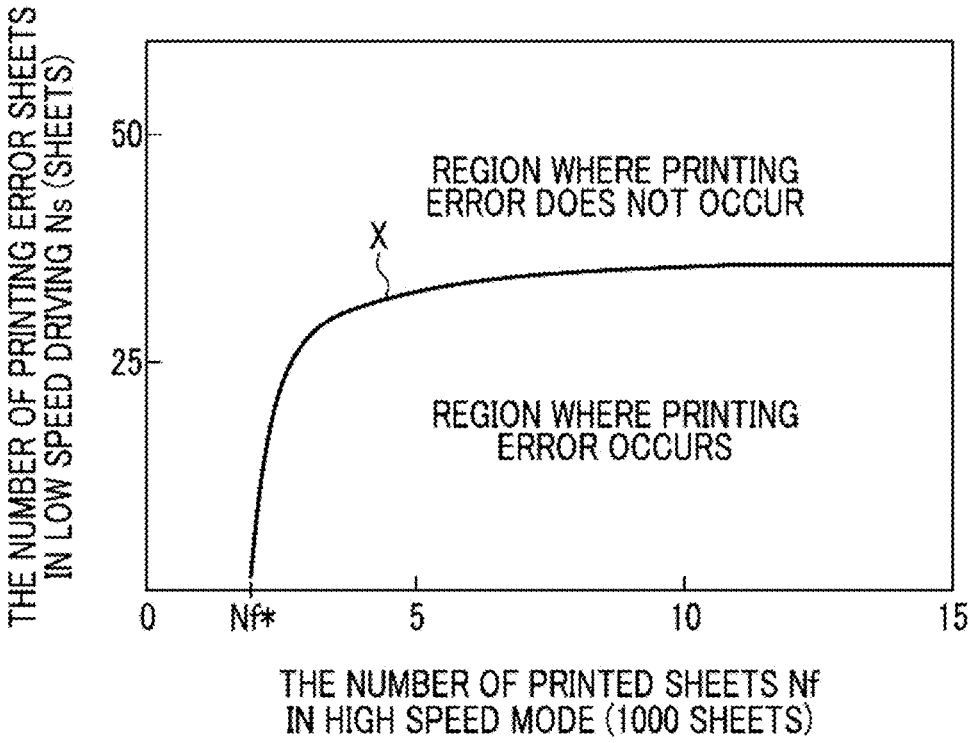
FIG. 7 is a graph illustrating relationship between the number of printed sheets in a high speed mode and the number of printing error sheets in low speed driving in an image forming device according to a first exemplary embodiment.

FIG. 7 is a graph illustrating a relationship between the number of printed sheets Nf (transverse axis) in the high speed mode and the number of printing error sheets Ns (longitudinal axis) in the low speed driving. The longitudinal axis represents how many printing error sheets occur when the printing is executed while the developing unit 74 is being driven at the low speed. That is, the printing error occurs on a lower side of a curve X illustrated in FIG. 7, and the printing error does not occur on an upper side thereof. When the developing unit 74 is driven at the low speed for printing, a predetermined image (hereinafter, may be referred to as a "standard image") may be printed onto the sheet member P of a predetermined size.

As described above, as the time when the printing is performed in the high speed mode is lengthened, the remaining develop TG is easily generated. Accordingly, FIG. 7 illustrates the number of printed sheets in which the printing error does not occur when the developing unit 74 is driven at the low speed after the printing is performed up to the number of printed sheets in the high speed mode, that is, illustrates the number of printed sheets in which the remaining developer TG disappears by the discharging operation due to the low speed driving when the developing unit 74 is driven at the low speed.

On the other hand, until the number of printed sheets in the high speed mode reaches a predetermined number of sheets, the remaining developer TG that may cause a trouble is not formed, and thus, the printing error in the low speed driving of the developing unit 74 does not occur. That is, a predetermined threshold value is present in the number of printed sheets in the high speed mode in which the printing error occurs in the low speed driving of the developing unit 74. In FIG. 7, the threshold value is indicated as Nf*. Further, hereinafter, the number of printing error sheets Ns in the low speed driving of the developing unit 74 read for a point on a curve X is referred to as "the number of loss sheets Nd". The number of loss sheets Nd may correspond to the number of printed sheets Nf in the high speed mode, and for example, may be stored in a storage unit such as the ROM 20B in an LUT (look up table) form.

In the exemplary embodiment, "the printing error does not occur" or "the remaining developer TG disappears" includes a case where "the printing error reaches a predetermined reference value or lower" or "the remaining developer TG decreases down to a predetermined reference value or lower".

Figure 8:
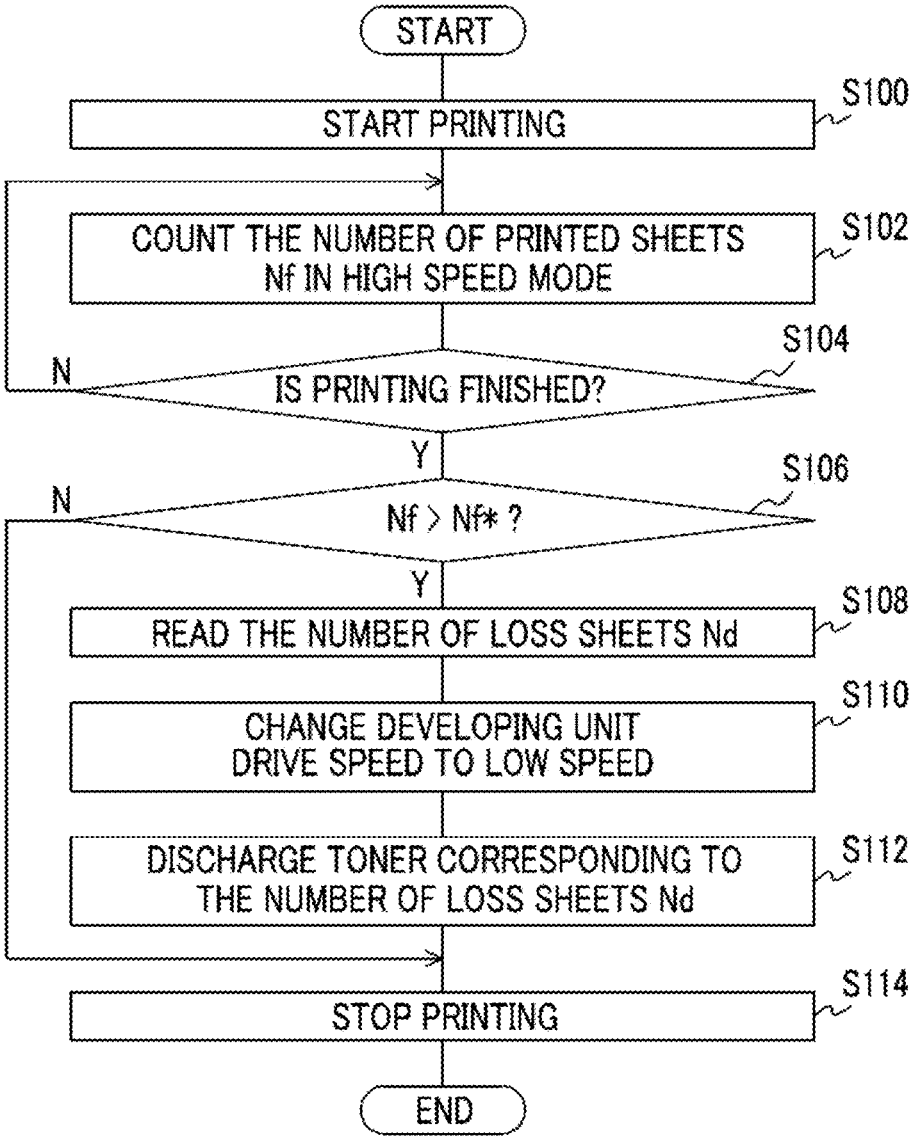
FIG. 8 is a flowchart illustrating the flow of processing of a toner agitating process program according to the first exemplary embodiment.

Next, in the image forming process, the toner agitating process executed by the image forming device 10 according to the exemplary embodiment will be described with reference to FIG. 8. In the toner agitating process in the exemplary embodiment, the agitating and discharging operation is performed. FIG. 8 is a flowchart illustrating the flow of processing of a toner agitating process program executed by the CPU 20A of the image forming device 10 according to the exemplary embodiment, in this case.

In the process illustrated in FIG. 8, for example, after the main control section 20 receives image information for image formation from the original document reading section 16 or the like, a user instructs the start of printing by designating the number of sheets to be printed through the UI panel 20D or the like, and then, the CPU 20A reads the toner agitating process program from the storage unit such as the ROM 20B for execution.

In the exemplary embodiment, the number of loss sheets Nd is calculated from FIG. 7 based on the number of printed sheets Nf in the high speed mode, formation of toner images corresponding to the number of loss sheets Nd is executed, and the toner agitating process of the developer G is performed. In the exemplary embodiment, it is assumed that the printing start is already instructed by the user through the UI panel 20 or the like and the high speed mode is selected as the printing mode at that time. Further, the printing mode may be selected by an input of the user through the UI panel 20D, or for example, may be selected according to the determination of the CPU 20A based on a characteristic such as the thickness of the sheet members P when the original document is read by the original document reading section 16.

In this way, in the exemplary embodiment, the configuration in which the toner agitating process program is stored in advance in the ROM 20B or the like is described, but the invention is not limited thereto, and for example, a configuration in which the toner agitating process program is provided in the state of being stored in a computer readable portable storage medium, or a configuration in which the toner agitating process program is distributed through a communication unit in a wired or wireless manner may be used.

Further, in the exemplary embodiment, the toner agitating process is realized by the software configuration that executes the program using the computer, but the invention is not limited thereto. For example, the process may be realized by a hardware configuration using an application specific integrated circuit (ASIC), or by a combination of the hardware configuration and the software configuration.

As illustrated in FIG. 8, the printing is started in step S100, and then, the number of printed sheets Nf in the high speed mode is counted by a counter provided in the CPU 20A, for example, in step S102.

In the next step S104, it is determined whether the printing is finished. If the determination result is negative, the procedure returns to step S102 to continue the counting of the number of printed sheets Nf. If the determination result is positive, the procedure proceeds to step S106.

In the next step S106, it is determined whether the number of printed sheets Nf is larger than the threshold value Nf*. If the determination result is negative, the procedure proceeds to step S114 to then stop the printing, and then, the toner agitating proceeding program ends. This is because when the number of printed sheets Nf is the threshold value Nf* or lower, it is considered that the remaining developer TG that causes the trouble is not generated in the housing 116, as described above.

On the other hand, if the determination result is positive in step S106, the procedure proceeds to step S108, and the number of loss sheets Nd is read from the above-described LUT or the like stored in the storage unit such as the ROM 20B.

In the next step S110, the rotational speed of the developing unit 74 (the developing roller 75, the first agitating carriage auger 112 and the second agitating carriage auger 114) is changed to the low speed driving while maintaining the image holding member 62 at the speed in the high speed mode. In this case, as the rotational speed in the low speed driving, a speed necessary and sufficient for breaking, agitating and carrying the remaining developer TG, set in advance by an experiment or the like may be applied, or the rotational speed of the developing unit 74 in the low speed mode may be applied.

In the next step S112, while the developing unit 74 is being maintained at the low speed driving, the toner images corresponding to the number of loss sheets Nd are formed on the image holding member 62 and the discharging operation is executed. In this case, in the discharging operation, the above-described standard image may be actually printed on the sheet member P, or the toner image may be formed on the image holding member 62 without using the sheet member P to then cleaned by the cleaning member 76. In the exemplary embodiment, the agitating and discharging operation in the low speed driving is executed in the cycle-down period (see FIG. 6) after the printing in the high speed mode is finished. The number of the toner images to be formed on the image holding member 62 is not limited to the number of loss sheets Nd, and may be any number as long as the number of the toner images is the number of loss sheets Nd or more.

After the printing is stopped in the next step S114, the toner agitating process program ends.

Here, a control for changing the driving mode of the developing unit 74 and the image holding member 62 to the low speed driving in step S110 (a control for changing the speed condition of the developing unit 74 and the image holding member 62 to the same speed condition as the low speed mode) to execute the discharging operation in step S112 may be considered. However, with such a control, it takes time to release the remaining of a two-component developer generated in the housing in the high speed mode, and thus, the productivity in image formation deteriorates.

According to the image forming device according to the exemplary embodiment, the productivity in image formation is suppressed from deteriorating, compared with a case where such a control is performed.

In the above-described embodiment, the number of printed sheets is used as an index when the printing amount is determined in the high speed mode, but the invention is not limited thereto. For example, a printing time may be used as the index. In this case, a graph corresponding to the graph illustrated in FIG. 7 may be created in advance by calculating the number of printing error sheets Ns in the low speed driving with respect to the printing time in the high speed mode. Further, in the flowchart in FIG. 8, in step S102, the printing time in the high speed mode may be measured, and in step S106, it may be determined whether the measured time is larger than a predetermined threshold value for the printing time in the predetermined high speed mode.

Further, in the above-described exemplary embodiment, the adjustment of the discharging amount is performed by the number of loss sheets Nd, but the invention is not limited thereto. For example, the adjustment may be performed by an area gradation ratio (an index indicating the density of an image, which may be hereinafter referred to as "Cin").

Further, in the above-described exemplary embodiment, the agitating and discharging operation is executed in the cycle-down period, but the invention is not limited thereto. For example, the agitating and discharging operation may be executed in the cycle-up period. In this case, the number of printed sheets in the high speed mode up to that time or the printing time in the high speed mode may be stored in the storage unit such as the RAM 20C to then be read in the cycle-up period, and the agitating and discharging operation based on the number of printed sheets or the printing time may be executed according to the flowchart illustrated in FIG. 8.

Second Exemplary Embodiment

The image forming device 10 according to the exemplary embodiment will be described with reference to FIGS. 9 and 10B. In the first exemplary embodiment, the number of loss sheets Nd is changed according to the number of printed sheets Nf in the high speed mode to execute the agitating and discharging operation in the cycle-down period, but in the exemplary embodiment, the agitating and discharging operation is executed in the cycle-up period or during printing.

Figure 9:
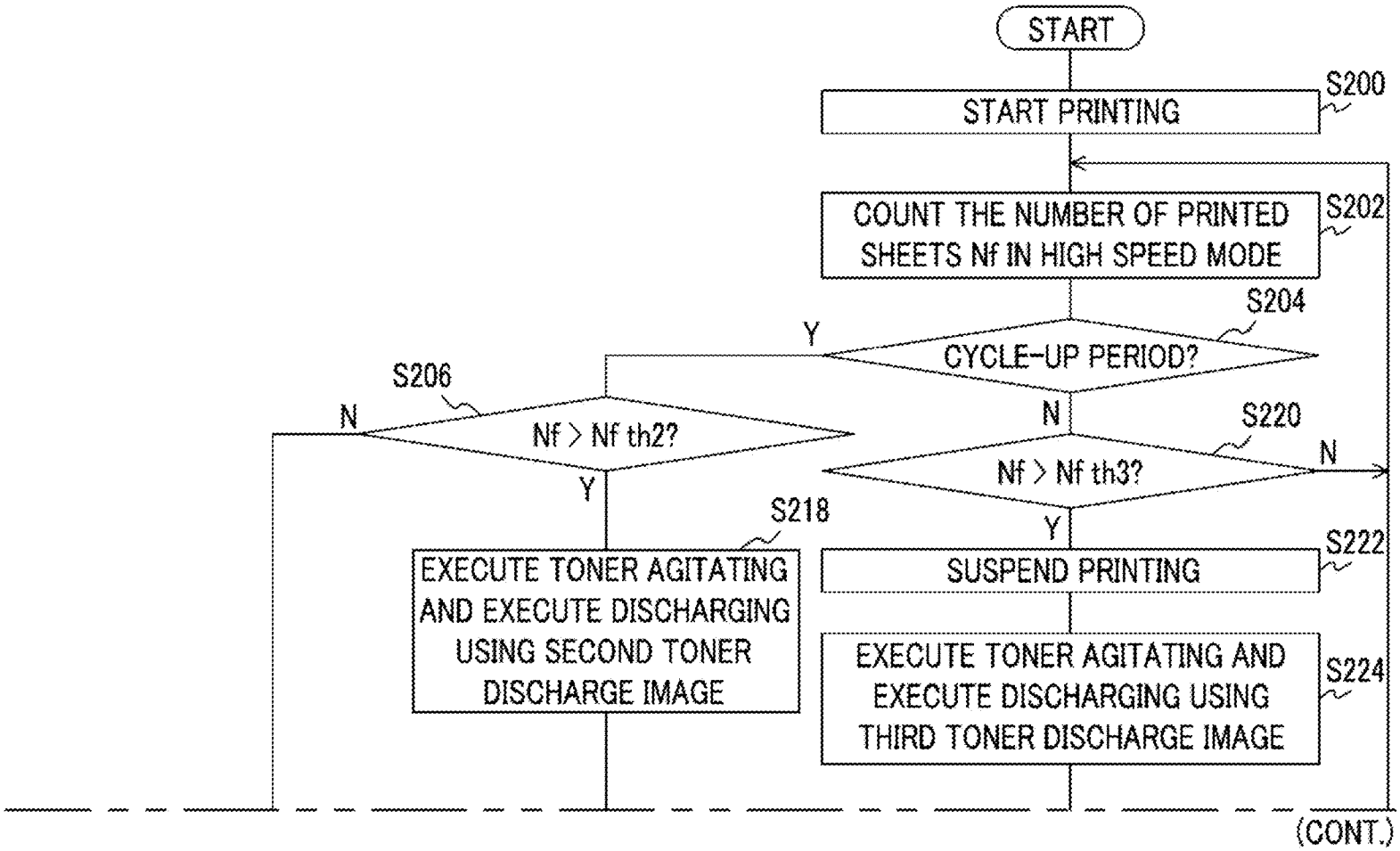
FIG. 9 is a flowchart illustrating the flow of processing of a toner agitating process program according to a second exemplary embodiment.

FIG. 9 is a flowchart illustrating the flow of processing of the toner agitating process program executed by the CPU 20A of the image forming device 10 according to the exemplary embodiment. In the exemplary embodiment, it is similarly assumed that a user already instructs the start of printing through the UI panel 20D or the like and the high speed mode is selected as a printing mode at that time. Further, it is assumed that the size relationship of threshold values Nfth1, Nfth2 and Nfth3 of the number of printed sheets Nf in the high speed mode to be described hereinafter satisfies Nfth1<Nfth2<Nfth3. Specific values of Nfth1, Nfth2 and Nfth3 correspond to Nfth1=1000, Nfth2=2000 and Nfth3=3000, for example.

In FIG. 9, the printing is started in step S200, and then, the number of printed sheets Nf in the high speed mode is counted by the counter provided in the CPU 20A, for example, in the next step S202.

In the next step S204, it is determined whether the state of the image forming device 10 is in the cycle-up period.

If the determination result is negative in step S204, the procedure proceeds to step S220, and if the determination result is positive, the procedure proceeds to step S206 to determine whether the number of printed sheets Nf is larger than the threshold value Nfth2.

If the determination result is positive in step S206, the procedure proceeds to step S218, and if the determination result is negative, the procedure proceeds to step S208 to determine whether the number of printed sheets Nf is larger than the threshold value Nfth1.

If the determination result is positive in step S208, the procedure proceeds to step S216, and if the determination result is negative, the procedure proceeds to step S210 to reset the counter for the number of printed sheets Nf. This is because the counted value does not reach the number of printed sheets Nf for executing the agitating and discharging operation.

In the next step S212, it is determined whether the printing is finished, and if the determination result is negative, the procedure returns to step S202 to continue the counting of the number of printed sheets Nf. On the other hand, if the determination result is positive, the procedure proceeds to the next step S124 to stop the printing, and then, the toner agitating process program ends.

The determination on whether the printing is finished may be performed according to whether the number of printed sheets reaches the number of sheets to be printed, designated by the user through the UI panel 20D or the like.

On the other hand, if the determination result is positive in step S208, the procedure proceeds to step S216, and the agitating and discharging operation is executed, and then, the procedure proceeds to step S210. In this case, the discharging operation is executed by changing the speed mode of the developing unit 74 to the low speed driving and by using a first toner discharging image GT1.

Figure 10A:
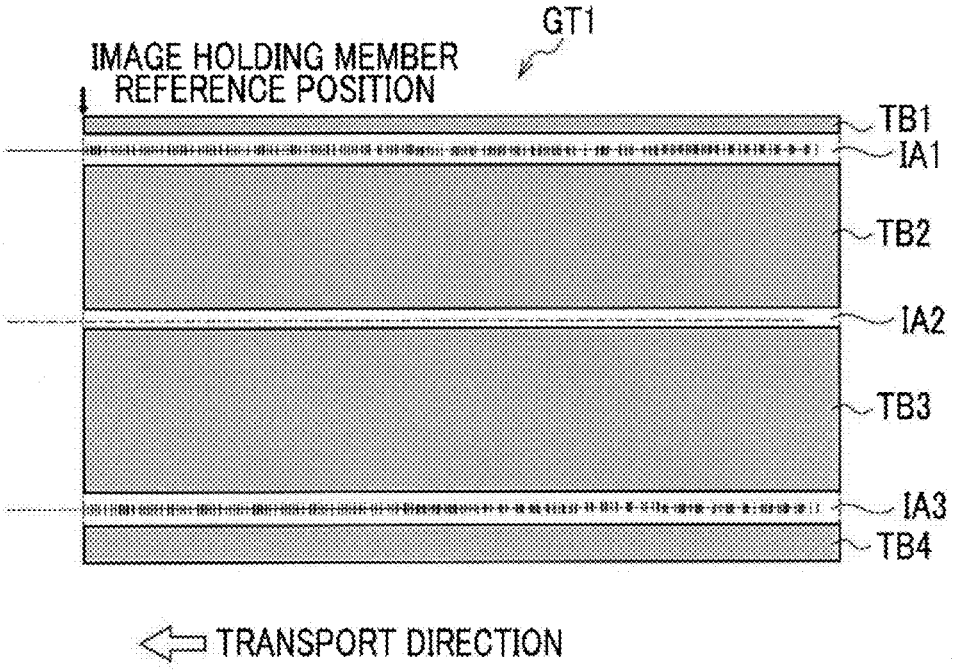
FIGS. 10A and 10B are development views illustrating a toner discharge image according to the second exemplary embodiment.

FIG. 10A illustrates an example of the first toner discharging image GT1. The first toner discharging image GT1 is also used as an image for image adjustment, for example, and includes toner agitating images TB1 to TB4 and image adjustment images IA1 to IA3. In the agitating and discharging operation in step S216, the image forming device 10 is in the cycle-up period and is thus in a state where the printing is not executed on the sheet member P, and a toner image of the first toner discharging image GT1 is formed on the image holding member 62, and the toner of the formed toner image is cleaned by the cleaning member 76. Accordingly, FIG. 10A is a development view obtained by cutting and opening the image holding member 62 at an image holding member reference position illustrated in the same figure. The first toner discharging image GT1 may be stored in the storage unit such as the ROM 20B.

Here, the image adjustment refers to an image quality adjustment that is regularly or irregularly executed in the image forming device or an image positional deviation adjustment. The image quality adjustment is also referred as a process control, and for example, adjusts a developing bias potential, a supply rate of the toner or the like. In the image quality adjustment, a reference image (patch) is formed on the image holding member 62, and the density of the reference image is detected to obtain parameter information about the developing bias potential or the like.

On the other hand, the image positional deviation adjustment is referred to as a registration control, in which a toner image is formed on the image holding member 62, and an output timing (horizontal synchronization and vertical synchronization) of image information is controlled from a timing when the toner image is read by a density sensor or the like to correct the positional deviation. The image adjustment images IA1 to IA3 illustrated in FIG. 10A illustrate images for the registration control.

Returning to FIG. 9, if the determination result is positive in step S206, the procedure proceeds to step S218, and the agitating and discharging operation is executed. Then, the procedure proceeds to step S210. In this case, the discharging operation is executed by changing the speed mode of the developing unit 74 to the low speed driving and by using a second toner discharging image GT2.

Figure 10B:
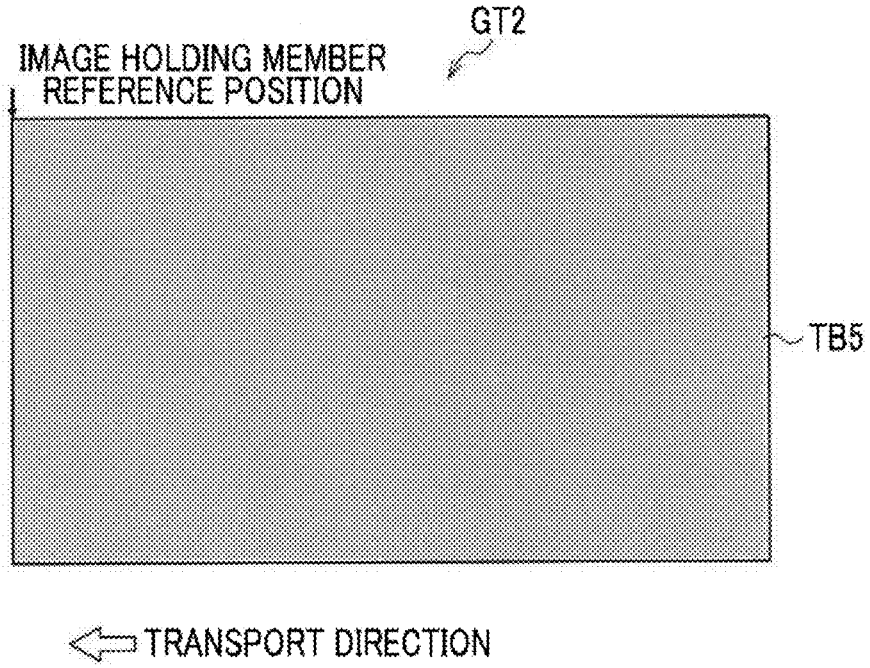

FIG. 10B illustrates an example of the second toner discharging image GT2. As illustrated in FIG. 10B, the second toner discharging image GT2 is an image (a so-called solid image) that includes a toner agitating image TB5 of a predetermined Cin, for example. In the discharging operation according to the exemplary embodiment, in a state where the printing is not performed on the sheet member P, a toner image of the second toner discharging image GT2 is formed on the image holding member 62, and the toner of the formed toner image is cleaned by the cleaning member 76. Accordingly, FIG. 10B is a development view obtained by cutting and opening the image holding member 62 at the image holding member reference position, similarly to FIG. 10A. The second toner discharging image GT2 may be stored in the storage unit such as the ROM 20B together with Cin necessary for the discharging operation, determined in advance by an experiment or the like.

On the other hand, if the determination result is negative in step S204, in step S220, it is determined whether the number of printed sheets Nf is larger than the threshold value Nfth3. If the determination result is negative, the procedure proceeds to step S202 to continue the counting of the number of printed sheets Nf, and if the determination result is positive, the procedure proceeds to step S222 to stop the printing on the sheet member P.

In the next step S224, the agitating and discharging operation is executed. In this case, the agitating and discharging operation is executed by changing the speed mode of the developing unit 74 to the low speed driving and by using a third toner discharging image GT3 (not illustrated).

The third toner discharging image GT3 according to the exemplary embodiment is, for example, the same image as the second toner discharging image GT2 illustrated in FIG. 10B, that is, an image that includes the toner agitating image TB5 of the predetermined Cin. In the discharging operation according to the exemplary embodiment, in a state where the printing is stopped, when the sheet member P is continuously supplied, at a timing (a so-called inter-image) between the sheet member P and the sheet member P, a toner image of the third toner discharging image GT3 is formed on the image holding member 62, and the toner of the formed toner image is cleaned by the cleaning member 76.

The third toner discharging image GT3 may be stored in the storage unit such as the ROM 20B, for example, together with Cin necessary for the discharging operation, determined in advance by an experiment or the like.

Here, since the discharging amount increases as Cin is large, Cin of the third toner discharging image GT3 according to the exemplary embodiment is a value larger than Cin of the second toner discharging image GT2.

In the next step S226, the printing is restarted, and the procedure proceeds to the processes of the above-described step S212 and thereafter.

As is obvious from the above description, according to the image forming device according to the exemplary embodiment, it is similarly possible to release the two-component developer generated in the housing in the high speed mode while suppressing deterioration of the productivity in image formation.

In the above-described exemplary embodiments, the image forming device 10 has two modes of the high speed mode and the low speed mode as the process speed, but the invention is not limited thereto, and three or more process speeds may be employed. For example, when there are three modes of a high speed mode, an intermediate speed mode and a low speed mode, the number of printed sheets Nf in the high speed mode may be weighted to be integrated in each mode. That is, when the number of printed sheets in the high speed mode is N1 and the number of printed sheets in the intermediate speed mode is N2, and when a weighting factor in the high speed mode is k1 and a weighting factor in the intermediate speed mode is k2, the number of printed sheets Nfw in the high speed mode may be calculated as $Nfw=N1\times k1+N2\times k2$. In this case, for example, when the number of printing error sheets Ns in the low speed driving is calculated from FIG. 7 in the first exemplary embodiment, the graph may be read under the assumption that Nfw represents the number of printed sheets in the high speed mode on the transverse axis.

Further, in the above-described exemplary embodiments, the example in which the developing unit 74 is changed to the low speed driving so that the agitating and discharging operation is executed is illustrated, but the invention is not limited thereto, and only the rotational speeds of the augers may be changed to the low speed driving so that the agitating and discharging operation is executed. In this case, the driving motors of the developing roller 75 and the augers in the developing unit 74 may be separately provided.

Further, in the above-described exemplary embodiments, the number of printed sheets or the printing time in the high speed mode is used as the index of the timing when the agitating and discharging operation is executed, but the invention is not limited thereto, and the supply amount (dispense amount) or supply time of the toner, the image density in the image information to be printed, environments (temperature and humidity), or the like may be used.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming device comprising:

an image holding member that is rotatable at a first speed and a second speed slower than the first speed;

a developing unit that includes:

a developing part that is rotatable at a third speed and a fourth speed slower than the third speed and supplies a two-component developer including toner and carrier to the image holding member to develop a latent image formed on the image holding member with the toner; and a carrying part that is rotatable at a fifth speed and a sixth speed slower than the fifth speed and carries the two-component developer supplied to the developing part while agitating the two-component developer in an accommodating part; and a control unit that executes a change of a high speed mode in which the image holding member is operated at the first speed, the developing part is operated at the third speed and the carrying part is operated at the fifth speed to perform development and a low speed mode in which the image holding member is operated at the second speed, the developing part is operated at the fourth speed and the carrying part is operated at the sixth speed to perform development, the control unit performing a control so that when an amount corresponding to an amount of the toner supplied to the image holding member by the development in the high speed mode exceeds a threshold value, the carrying part rotates at a speed that is slower than the first speed while maintaining the image holding member at the first speed.

2. The image forming device according to claim 1, wherein the control unit performs a control so that when the carrying part is controlled to rotate at a speed slower than the first speed, the toner of an amount that is equal to or larger than an amount of the toner necessary for releasing remaining of the two-component developer generated in the accommodating part is discharged to the image holding member from the developing part.

3. The image forming device according to claim 2, wherein the control unit performs a control so that latent images of a predetermined image for a predetermined number are formed on the image holding member with a predetermined density and the formed latent image is developed to discharge the toner.

4. The image forming device according to claim 3, wherein in a cycle-up period for an operation preparation process before transfer of a toner image onto a recording medium is started, image information about the predetermined image when the control is performed so that the formed latent image is developed to discharge the toner includes adjustment image information for adjusting the image quality or a position of the toner image to be formed on the image holding member.

5. The image forming device according to claim 1, wherein an amount corresponding to the amount of the toner is any one of a supply amount of the two-component developer supplied to the carrying part, a number of accumulated sheets of recording mediums onto which the toner image formed on the image holding member by the development of the developing part is transferred, and an accumulated transfer time.

6. The image forming device according to claim 2, wherein an amount corresponding to the amount of the toner is any one of a supply amount of the two-component developer supplied to the carrying part, a number of accumulated sheets of recording mediums onto which the toner image formed on the image holding member by the development of the developing part is transferred, and an accumulated transfer time.

7. The image forming device according to claim 3, wherein an amount corresponding to the amount of the toner is any one of a supply amount of the two-component developer supplied to the carrying part, a number of accumulated sheets of recording mediums onto which the toner image formed on the image holding member by the development of the developing part is transferred, and an accumulated transfer time.

8. The image forming device according to claim 4, wherein an amount corresponding to the amount of the toner is any one of a supply amount of the two-component developer supplied to the carrying part, a number of accumulated sheets of recording mediums onto which the toner image formed on the image holding member by the development of the developing part is transferred, and an accumulated transfer time.

9. The image forming device according to claim 1, wherein when the amount corresponding to the amount of the toner in transfer of a toner image formed on the image holding member by development of the developing part onto the recording medium exceeds a threshold value, the control unit suspends the transfer of the toner image onto the recording medium and restarts the transfer of the toner image onto the recording medium after finishing control for controlling the carrying part to rotate at a speed slower than the first speed.

10. The image forming device according to claim 2, wherein when the amount corresponding to the amount of the toner in transfer of a toner image formed on the image holding member by development of the developing part onto the recording medium exceeds a threshold value, the control unit suspends the transfer of the toner image onto the recording medium and restarts the transfer of the toner image onto the recording medium after finishing control for controlling the carrying part to rotate at a speed slower than the first speed.

11. The image forming device according to claim 3, wherein when the amount corresponding to the amount of the toner in transfer of a toner image formed on the image holding member by development of the developing part onto the recording medium exceeds a threshold value, the control unit suspends the transfer of the toner image onto the recording medium and restarts the transfer of the toner image onto the recording medium after finishing control for controlling the carrying part to rotate at a speed slower than the first speed.

12. The image forming device according to claim 4, wherein when the amount corresponding to the amount of the toner in transfer of a toner image formed on the image holding member by development of the developing part onto the recording medium exceeds a threshold value, the control unit suspends the transfer of the toner image onto the recording medium and restarts the transfer of the toner image onto the recording medium after finishing control for controlling the carrying part to rotate at a speed slower than the first speed.

13. The image forming device according to claim 5, wherein when the amount corresponding to the amount of the toner in transfer of a toner image formed on the image holding member by development of the developing part onto the recording medium exceeds a threshold value, the control unit suspends the transfer of the toner image onto the recording medium and restarts the transfer of the toner image onto the recording medium after finishing control for controlling the carrying part to rotate at a speed slower than the first speed.

14. The image forming device according to claim 6, wherein when the amount corresponding to the amount of the toner in transfer of a toner image formed on the image holding member by development of the developing part onto the recording medium exceeds a threshold value, the control unit suspends the transfer of the toner image onto the recording medium and restarts the transfer of the toner image onto the recording medium after finishing control for controlling the carrying part to rotate at a speed slower than the first speed.

15. The image forming device according to claim 7, wherein when the amount corresponding to the amount of the toner in transfer of a toner image formed on the image holding member by development of the developing part onto the recording medium exceeds a threshold value, the control unit suspends the transfer of the toner image onto the recording medium and restarts the transfer of the toner image onto the recording medium after finishing control for controlling the carrying part to rotate at a speed slower than the first speed.

16. The image forming device according to claim 8, wherein when the amount corresponding to the amount of the toner in transfer of a toner image formed on the image holding member by development of the developing part onto the recording medium exceeds a threshold value, the control unit suspends the transfer of the toner image onto the recording medium and restarts the transfer of the toner image onto the recording medium after finishing control for controlling the carrying part to rotate at a speed slower than the first speed.

17. A non-transitory computer readable recording medium that stores a program for controlling an image forming device including:

an image holding member that is rotatable at a first speed and a second speed slower than the first speed;

a developing unit that includes a developing part that is rotatable at a third speed and a fourth speed slower than the third speed and supplies a two-component developer including toner and carrier to the image holding member to develop a latent image formed on the image holding member with the toner; and a carrying part that is rotatable at a fifth speed and a sixth speed slower than the fifth speed and carries the two-component developer supplied to the developing part while agitating the two-component developer in an accommodating part, the program causing a computer to function as:

a control unit that executes a change of a high speed mode in which the image holding member is operated at the first speed, the developing part is operated at the third speed and the carrying part is operated at the fifth speed to perform development and a low speed mode in which the image holding member is operated at the second speed, the developing part is operated at the fourth speed and the carrying part is operated at the sixth speed to perform the development, the control unit performing a control so that when an amount corresponding to an amount of the toner supplied to the image holding member by the development in the high speed mode exceeds a threshold value, the carrying part rotates at a speed slower than the first speed while maintaining the image holding member at the first speed.

* * * * *